US008844099B2

(12) United States Patent
Puig

(10) Patent No.: US 8,844,099 B2
(45) Date of Patent: Sep. 30, 2014

(54) HANDLE DEVICE

(71) Applicant: Bel-Art Products, Wayne, NJ (US)

(72) Inventor: Miguel A. Puig, Sterling Forest, NY (US)

(73) Assignee: SP Industries Holdings, Inc., Warminster, PA (US)

( * ) Notice: Subject to any disclaimer, the term of this patent is extended or adjusted under 35 U.S.C. 154(b) by 0 days.

(21) Appl. No.: 14/048,648

(22) Filed: Oct. 8, 2013

(65) Prior Publication Data

US 2014/0101892 A1 Apr. 17, 2014

Related U.S. Application Data

(60) Provisional application No. 61/713,266, filed on Oct. 12, 2012.

(51) Int. Cl.
*B25G 1/10* (2006.01)

(52) U.S. Cl.
CPC ..... *B25G 1/102* (2013.01)
USPC ..... 16/430; 16/422

(58) Field of Classification Search
USPC ..... 16/422, 426, 430, 431, 436, DIG. 18, 16/DIG. 19; 30/322, 323, 147, 142; 15/145
See application file for complete search history.

(56) References Cited

U.S. PATENT DOCUMENTS 4,599,797 A * 7/1986 Bax ..... 30/323
5,058,230 A 10/1991 Hodosh et al.
5,479,708 A 1/1996 Thomas
5,535,484 A 7/1996 Gibson
5,762,344 A 6/1998 Einvall
5,774,921 A 7/1998 Harrison et al.
5,829,099 A 11/1998 Kopelman et al.
5,860,190 A 1/1999 Cano
5,875,510 A 3/1999 Lamond et al.
5,876,134 A 3/1999 Tseng et al.
5,926,901 A 7/1999 Tseng et al.
5,950,280 A * 9/1999 Taylor ..... 16/422
D417,122 S * 11/1999 Jagger ..... D7/401.2
6,134,790 A 10/2000 Watson
6,141,815 A 11/2000 Harrison et al.
6,170,123 B1 1/2001 Holland-Letz
6,363,568 B1 4/2002 Harrison et al.
6,390,704 B1 5/2002 Baudino et al.
6,471,186 B1 10/2002 Lawless
6,471,514 B2 10/2002 Beck et al.
6,485,211 B1 11/2002 Leo et al.
6,594,863 B2 * 7/2003 Spooner ..... 16/436
6,668,415 B2 12/2003 Rohrig
6,752,555 B2 6/2004 Geddes et al.
6,754,936 B2 6/2004 Erenaga (Continued)

*Primary Examiner* — Jeffrey O Brien
(74) *Attorney, Agent, or Firm* — Lowenstein Sandler LLP

(57) ABSTRACT

The present invention provides a handle device. The handle device includes a hollow body having an outer surface and an inner surface forming a cavity. A slot is formed within the cavity and at least one opening is formed at one end of the body for an insertion of a handle portion of an object. In one embodiment of the present invention, the opening is a modified T-structure of a substantially elongated shape including two tabs located in a center portion of the modified T-structure. The two tabs are substantially perpendicular to the elongated shape of the opening. In another embodiment, the opening is a modified star structure including a central aperture and four sides of a substantially elongated shape extending from the central aperture.

12 Claims, 14 Drawing Sheets

(56) References Cited

U.S. PATENT DOCUMENTS

| | | | |
|---|---|---|---|
| 6,772,994 | B1 | 8/2004 | Lawless |
| 7,204,387 | B2 | 4/2007 | Munari |
| 7,241,064 | B2 | 7/2007 | Yanagisako |
| 7,281,455 | B2 | 10/2007 | Hu |
| 7,284,300 | B1 | 10/2007 | Bruns |
| 7,293,331 | B2 | 11/2007 | Lawless |
| 7,367,735 | B2 | 5/2008 | Kanari |
| 7,574,776 | B2 | 8/2009 | Lawless |
| 7,805,813 | B1 | 10/2010 | Bunyard |
| 7,805,843 | B2 | 10/2010 | Landsberger et al. |
| 7,877,843 | B2 | 2/2011 | Holland-Letz |
| 7,930,804 | B2 | 4/2011 | Cornfield |
| 8,006,350 | B2 | 8/2011 | Chen |
| 8,182,361 | B2 | 5/2012 | Gill |
| 8,245,607 | B2 | 8/2012 | Kozak |
| 2003/0151269 | A1 | 8/2003 | Korellis et al. |
| 2003/0217437 | A1 * | 11/2003 | Chen ..... 16/422 |
| 2006/0025711 | A1 | 2/2006 | Bell et al. |
| 2007/0209161 | A1 | 9/2007 | Neering et al. |
| 2012/0110787 | A1 | 5/2012 | Quiggins et al. |
| 2012/0167348 | A1 | 7/2012 | Adams |

* cited by examiner

HANDLE DEVICE

RELATED APPLICATIONS

This application claims the benefit of U.S. Provisional Application Ser. No. 61/713,266 filed Oct. 12, 2012, entitled, "Handle Device", the entire content of which is incorporated herein by reference.

FIELD OF THE INVENTION

The present invention relates to handle devices, and more particularly, to a handle device adapted to securely accommodate and lock an object such as utensil, tool or an instrument.

BACKGROUND OF THE INVENTION

Handle devices for enhancing the ability of a person to hold and grip an object, tool, or implement are well known in the art. Such devices are typically used by people who have limited dexterity or strength. Among such individuals are persons with arthritis or someone who has suffered injury to the hands, or someone born with a physical disability. These types of devices are also used by children, particularly as they learn to use table utensils, and by other persons to facilitate the holding of many kinds of objects.

Many such handle devices that exist today that are comfortable and easy to hold in order to meet the needs of children and other individuals having physical or motor skill disabilities. However, these handle devices are not adaptable to easily accommodate and secure the objects. As such, the object tends to move inside the handle device and it can be easily removed from the handle device, hence causing a danger to the children and other individuals with physical disabilities. Thus, there is a need in the art to provide a handle device that not only accommodates the object but also firmly secures and locks the object in order to prevent any movement in the object inside the handle device. There is also a need in the art to provide a handle device that prevents the object to be easily removed from the handle device.

SUMMARY OF THE INVENTION

The present invention provides a handle device and methods of using the same. The handle device is adapted to securely accommodate and lock an object such as a utensil, tool or an instrument.

According to one aspect of the invention, there is provided a handle device, which includes a substantially hollow cylindrical body having an outer surface and an inner surface forming a cavity. A slot is formed within the cavity and at least one opening is formed at one end of the body for an insertion of an object.

In one embodiment, the opening is a modified T-structure of a substantially elongated shape including two tabs located in a center portion of the modified T-structure. The two tabs are substantially perpendicular to the elongated shape of the opening.

In another embodiment, the opening is a modified star structure including a central aperture and four sides of a substantially elongated shape extending from the central aperture.

In a further embodiment, a first opening is formed at a first end of the body and a second opening is formed at a second end (opposite to the first end) of the body.

In some embodiments, the first opening is a modified T-structure of a substantially elongated shape including two tabs located in a center portion of the modified T-structure. The two tabs are substantially perpendicular to the elongated shape of the first opening.

In other embodiments, the second opening is a modified T-structure of a substantially elongated shape including two tabs located in a center portion of the modified T-structure. The two tabs are substantially perpendicular to the elongated shape of the second opening.

BRIEF DESCRIPTION OF THE DRAWINGS

The present invention will be more readily understood from the detailed description of exemplary embodiments presented below considered in conjunction with the attached drawings, of which.

It is noted that the drawings are intended to depict only typical or exemplary embodiments of the invention and thus may not be necessarily to scale. Accordingly, the drawings should not be considered as limiting the scope of the invention. The invention will now be described in detail with reference to the accompanying drawings.

DETAILED DESCRIPTION OF THE INVENTION

Figure 1:
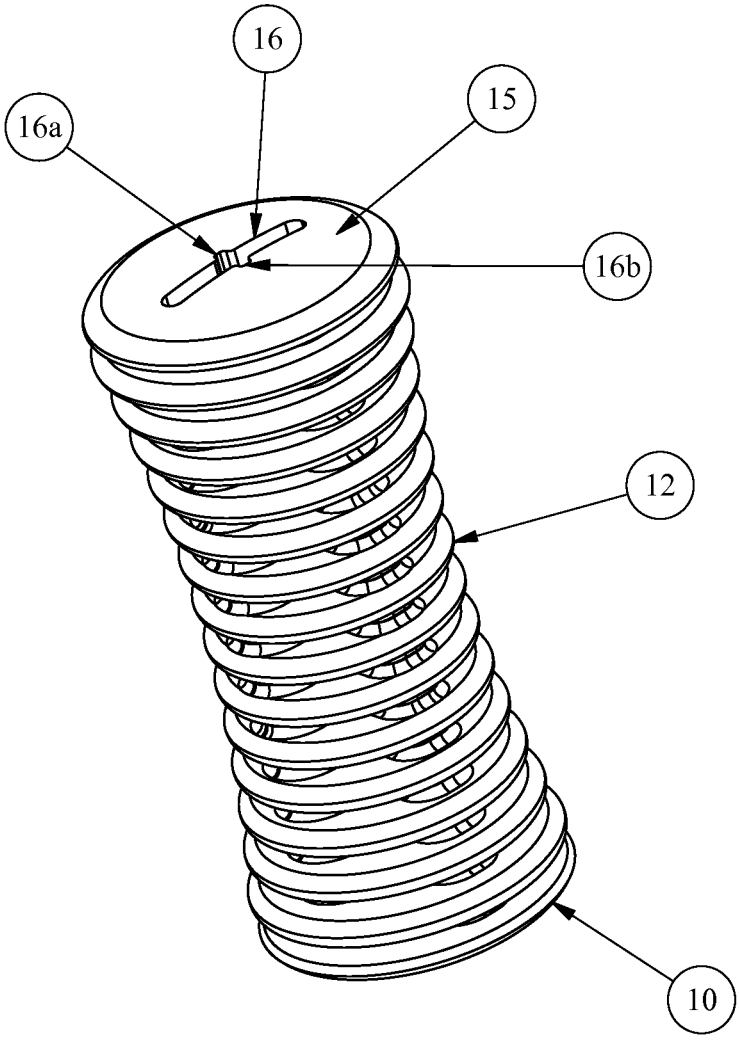
FIG. 1 is a top perspective view of a handle device in accordance with one embodiment of the present application.
Figure 1A:
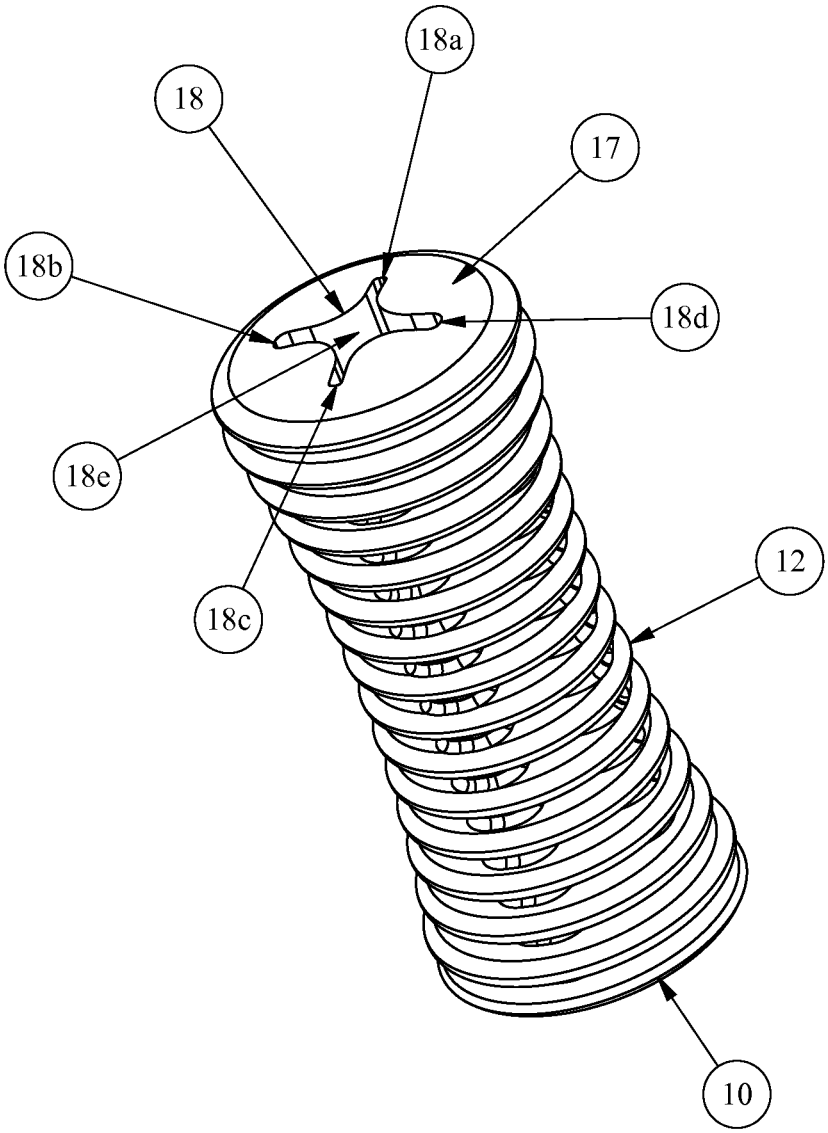
FIG. 1A is bottom perspective view of the handle device of FIG. 1 in accordance with the embodiment of the present application.
Figure 2:
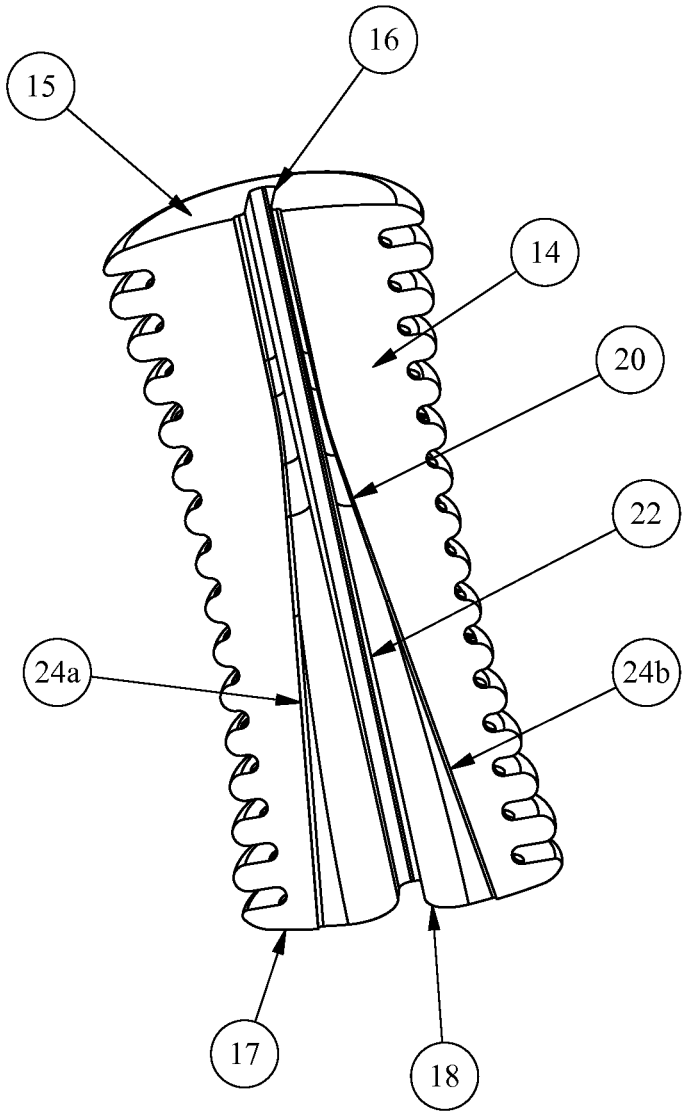
FIG. 2 is a cross section view of an inside portion of the handle device of FIG. 1 in accordance with the embodiment of the present application.

Referring to FIGS. 1, 1A and 2, there is shown a handle device 10 in accordance with an embodiment of the present invention. In one embodiment, the handle device 10 may have substantially hollow cylindrical body preferably made of elastomeric or polymeric material or combinations of both materials. The handle device 10 has an outer surface 12 and an inner surface 14. The handle device 10 includes a first end 15 having a first opening 16 and a second end 17, opposite the first end 13, having a second opening 18. Both the first and the second openings 16 and 18 are shaped and sized to accommodate an object such as a utensil, a tool or an instrument.

In one embodiment, as illustrated in FIG. 1, the first opening 16 is a modified T-structure having substantially elongated shape with two tabs 16*a* and 16*b* in a center portion of the opening 16. As shown, the two tabs 16*a* and 16*b* are substantially perpendicular to the elongated shaped of the first opening 16. Accordingly, the first opening 16 is shaped and sized to receive and lock an object within the inner surface of 14 of the handle device. In one embodiment, the first opening 16 receives and locks a handle of the object. As one example, the handle has a substantially flat shape.

Referring to FIG. 1A, there is shown a bottom perspective view of the handle device of FIG. 1. As illustrated in FIG. 1A, the second opening 18 is modified star structure having four sides 18*a*, 18*b* 18*c* and 18*d* and a central opening/aperture 18*e*. Each of the four sides 18*a*, 18*b*, 18*c* and 18*d* have a substantially elongate shape and stretch outwards from the central opening/aperture 18*e*. Specifically, the sides 18*a* and 18*c* of the opening 18 are substantially perpendicular to the sides 18*b* and 18*d* of the opening 18. Accordingly, the second opening 18 of the handle device 10 is shaped and sized to receive the object. In one embodiment, the second opening 18 receives a handle of the object. In one example, the handle of the object is of substantially round shape. In another example, the handle of the object is of substantially flat shape.

Referring to FIG. 2, there is shown a cross-section of the inner surface 14 of the handle device 10. As shown, the inner surface 14 includes a cavity 20 extending from the first end 15 to the second end 17. A slot 22 is formed inside the cavity. As shown, slot 22 expands from the first end 15 to the second end 17 such that opening in the slot 22 at the first end 15 is narrower than the opening in the slot 22 at the second end 17. As such, the slot 22 forms two angles 24*a* and 24*b* of approximately 15 degrees within the inner surface 14 of the handle device 10. In one embodiment, dimensions of the slot 22 are substantially similar to dimensions of the dimensions of the handle of the object such as a tool or instrument. As such, the slot 22 provides for secure placement of the object.

In one embodiment, the sides 18*b* and 18*d* of the second opening 18 are parallel to the substantially elongated first opening 16 of the handle device 10. In one embodiment, an object received at the first opening 16 may be pushed inside the cavity 20 and pulled out from the sides 18*b* and 18*d* of the second opening 18. Similarly, an object that may be received at the second opening 18 is pushed inside the cavity 20 via the sides 18*b* and 18*d* and pulled out from the first opening 16.

The operation of the handle device 10 will now be described with reference to FIGS. 3-5.

Figure 3A:
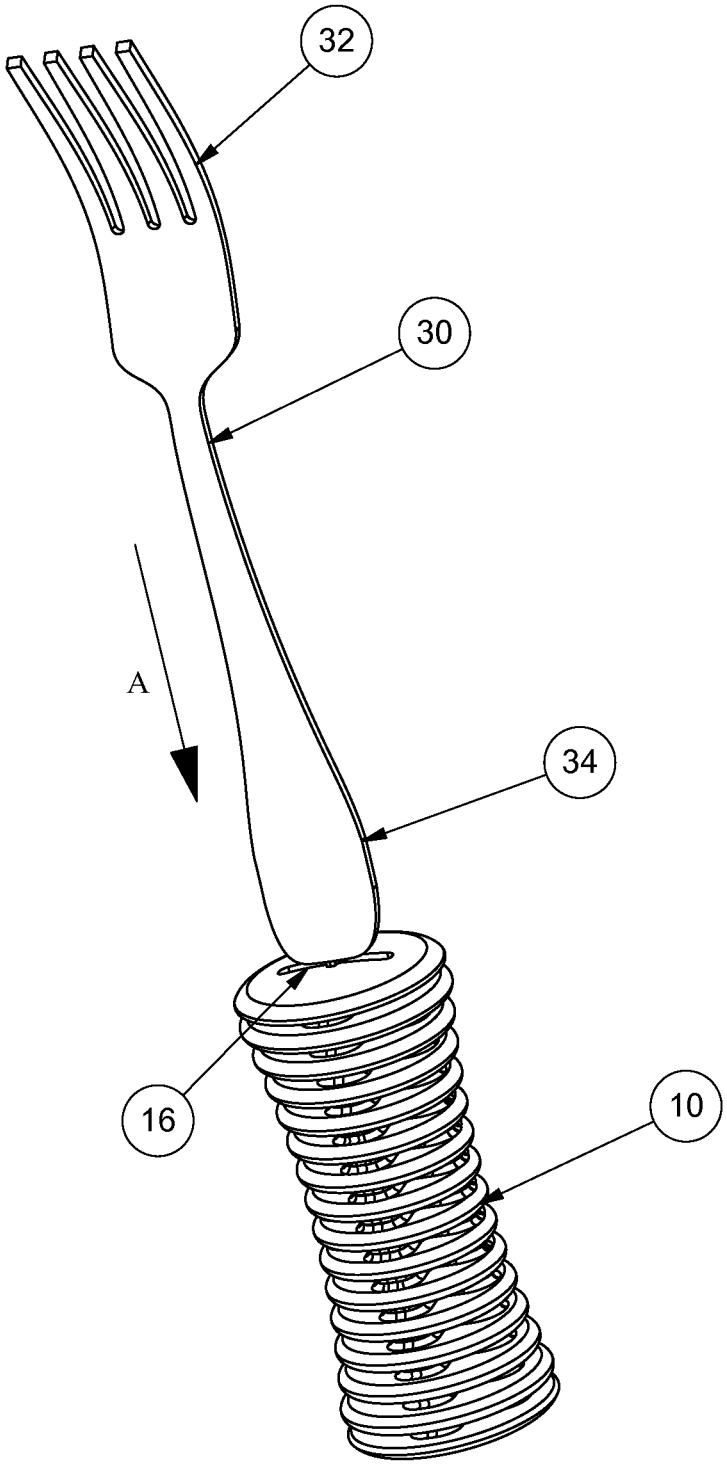
FIG. 3A is a schematic view of a utensil being inserted into the handle device of FIG. 1 in accordance with an another embodiment of the present application.

In one embodiment, FIG. 3A shows the orientation of the handle device 10 relative to a utensil 30 just prior to the attachment. Although, the utensil 30 is shown to be a fork, one of ordinary skill would appreciate that other utensils such as spoon, knife, spatula, turner, paintbrush or other utensils, tools or instruments that have a substantially flat handle may be used as the utensil 30 of the present invention. A typical utensil 30 such as the fork has two or more prongs 32 with an elongated handle portion 34 having a flat blade like shape. In order to attach the utensil 30 to the handle device 10, utensil 30 is aligned with the handle device 10 and the handle portion 34 is inserted into the first opening 16 of the handle device 10 in the direction of arrow A as shown in FIG. 3A. It should be understood that the utensil 30 is inserted into the first opening 16 such that lower part of the handle portion 34 is placed at the inner surface 14 of the handle device as will be described in detail below.

Figure 3B:
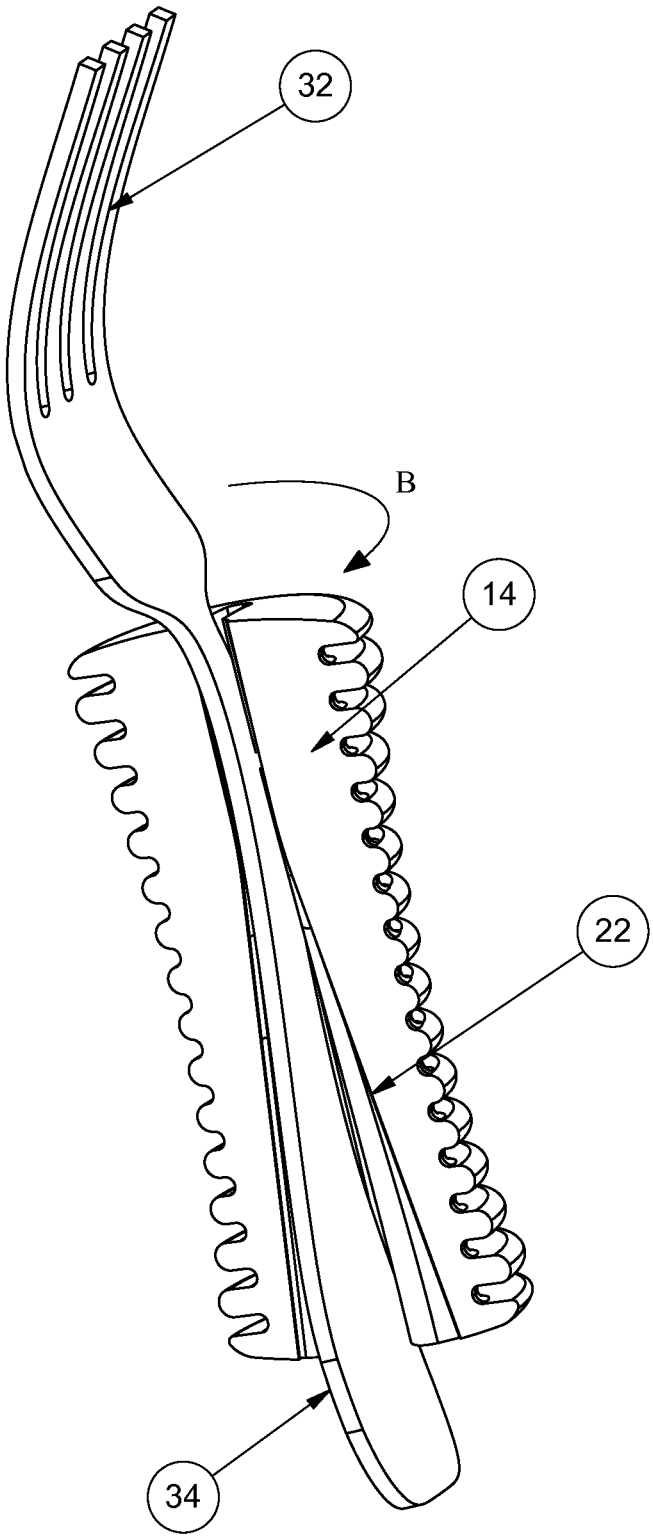
FIG. 3B is a schematic view of the utensil placed within the inside portion of the handle device of FIG. 1 in accordance with the another embodiment of the present application.
Figure 3C:
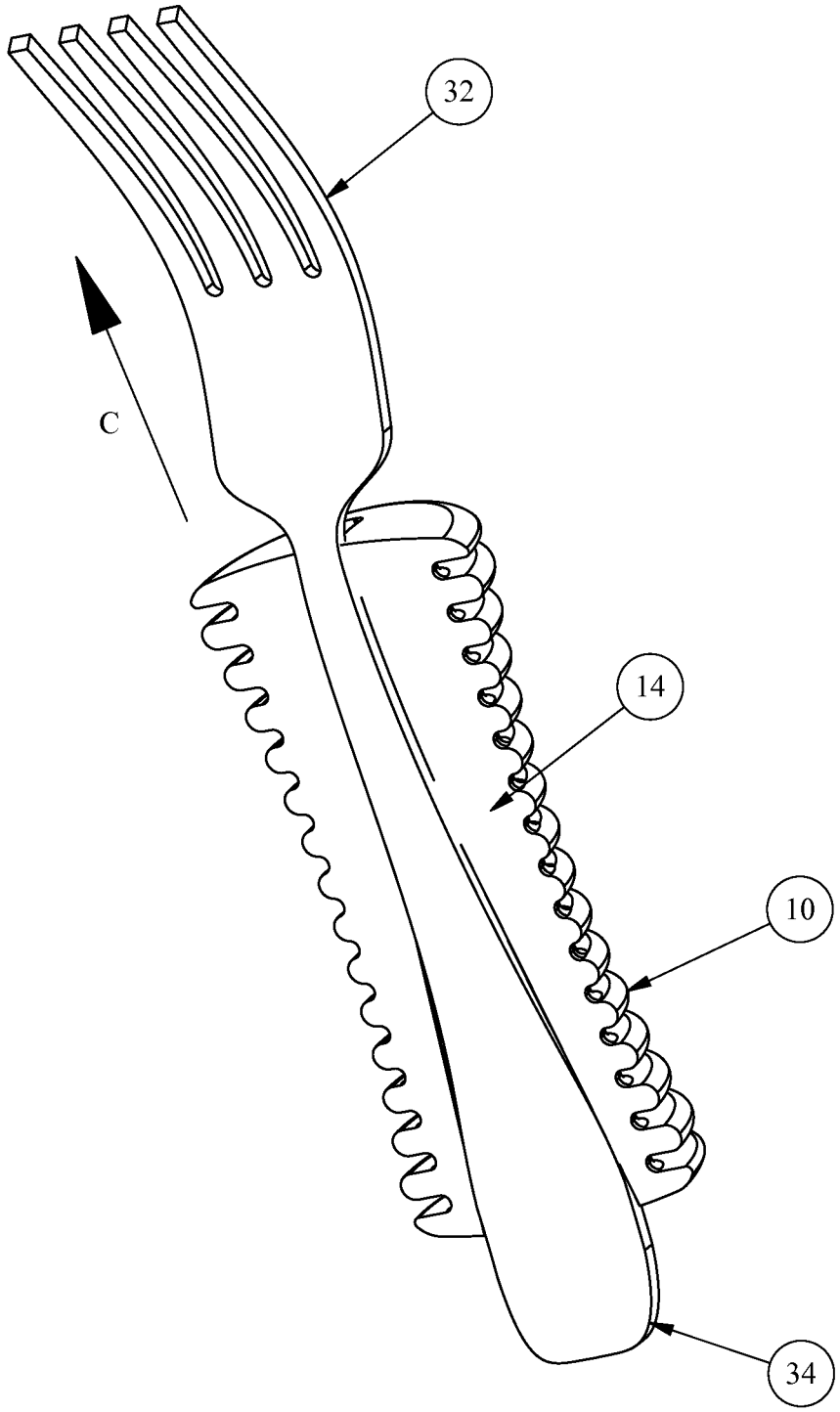
FIG. 3C is a schematic view of the utensil locked within the inside portion of the handle device of FIG. 1 in accordance with the another embodiment of the present application.
Figure 3D:
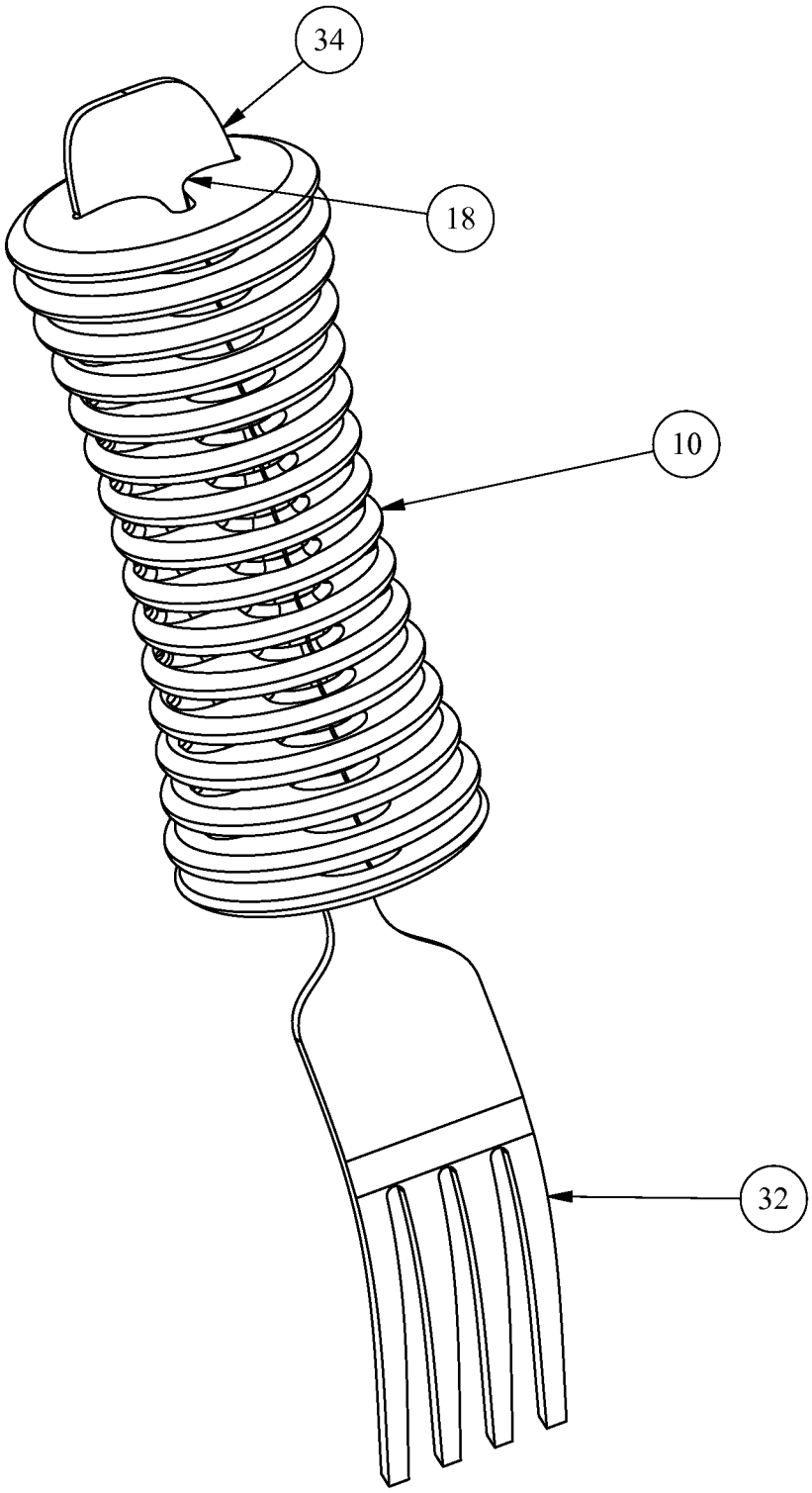
FIG. 3D is a schematic view of the utensil firmly secured within the inside portion of the handle device of FIG. 1 in accordance with the another embodiment of the present application.

As shown in FIG. 3B, the handle portion 34 slides into the cavity 20 of the handle device 10. The utensil 30 may easily be removed from the handle device 10 by simply pulling onto the prongs 32 of the utensil. Also, as shown, the utensil 30 is rotated approximately 90 degrees (e.g. in the direction of the arrow B) such that an upper part of the handle portion 34 fits securely into the tabs 16*a* and 16*b* of the first opening 16 and a lower part of the handle portion 34 fits securely into the slot 22 as shown in FIG. 3C. Accordingly, the handle portion 34 of the utensil 30 is locked at the first opening 16 of the handle device 10 such that the utensil 30 is not removable from the handle device 30. Further, as shown, the prongs 32 of the utensil 30 are being pulled upward in the direction C so that the handle device 10 grips the utensil 30 until the utensil 30 is snugged in place in the body of the handle device 10 as shown in FIG. 3D. By pulling the prongs 32 in the direction C, the handle portion 34 slides inside the slot 22 towards the first opening 16 until it cannot slide anymore at which point the utensil 30 is firmly secured inside the slot 22 such that the utensil 30 within the handle device 10 will not move even when the pressure is applied on it. As such, the utensil 30 is completely secured in the handle device 10.

Figure 3E:
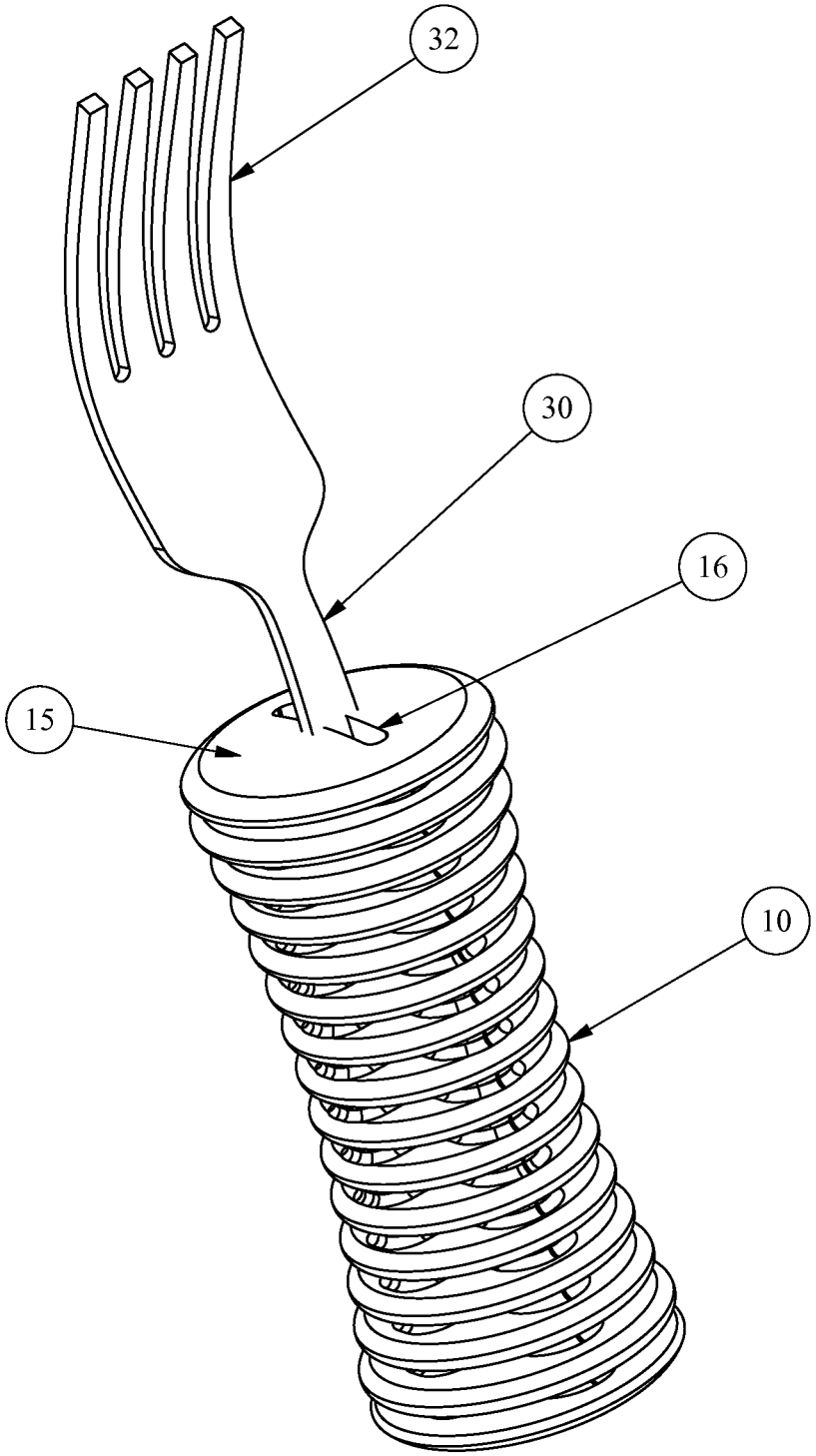
FIG. 3E is a schematic top view of the handle device of FIG. 1 including the utensil in accordance with the another embodiment of the present application.
Figure 3F:
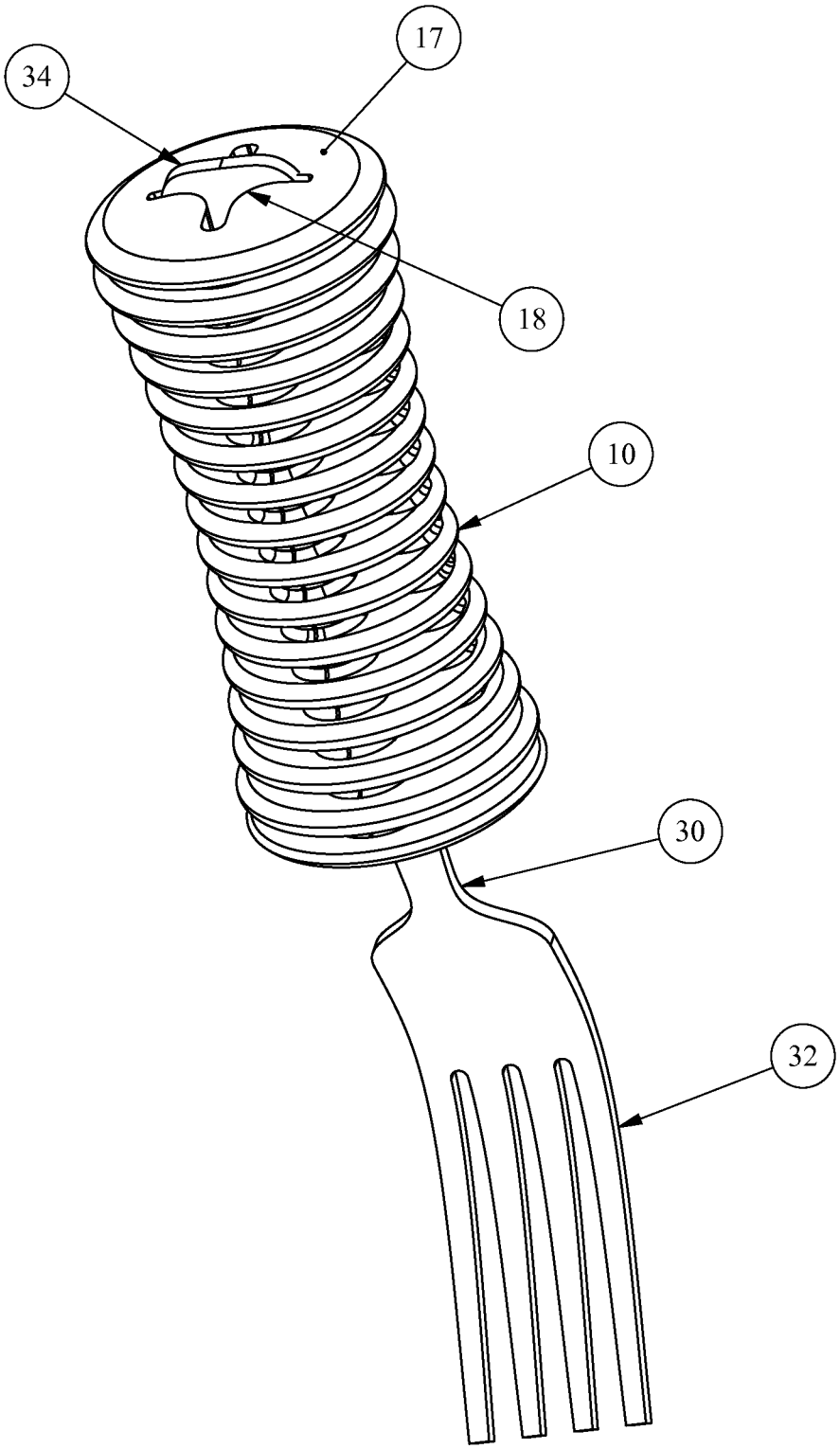
FIG. 3F is a schematic bottom view of the handle device of FIG. 1 including the utensil in accordance with the another embodiment of the present application.

Referring to FIG. 3E illustrates a top view of the utensil 30 securely placed inside the handle device 10. As shown, the upper part of the handle portion 34 of the utensil 30 is securely locked at the first opening 16 of the handle device 16. FIG. 3F illustrates a bottom view of the utensil 30 securely placed inside the handle device 10. As shown, the lower part of the handle portion 34 of the utensil 30 with the substantially flat end 30 exits through the second opening.

Figure 4A:
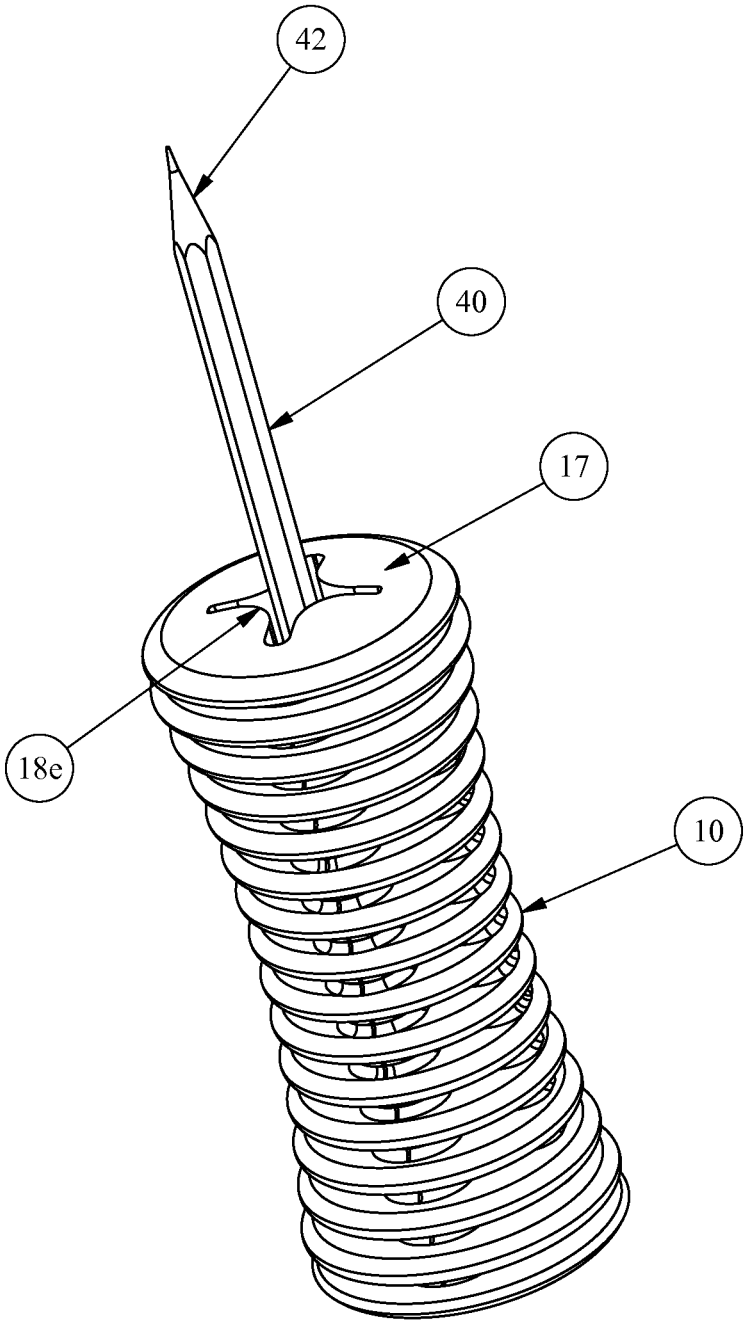
FIG. 4A is a top perspective view of an instrument inserted into the handle device of FIG. 1 in accordance with an alternate embodiment of the present application.
Figure 4B:
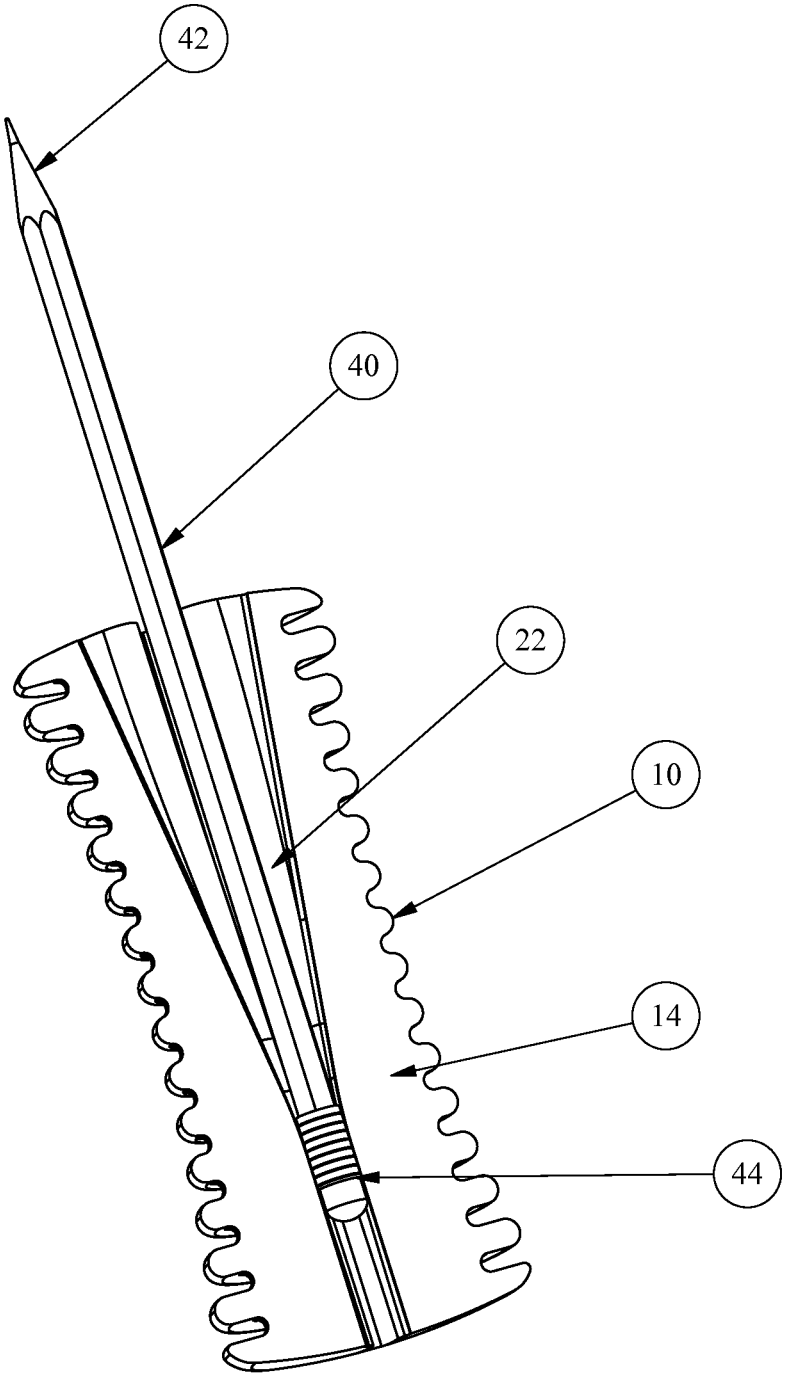
FIG. 4B is a schematic view of the instrument securely placed within the inside portion of the handle device of FIG. 1.

In another embodiment, FIG. 4A illustrates the handle device 10 with an instrument 40 inserted into the handle device 10. Although, the instrument 40 is shown to be a pencil, one of ordinary skill would appreciate that other instruments such as pens, markers, highlighters, toothbrushes, knitting needles, crochet needles, screw drivers, file handles, heel bars or other instruments and/or tools that have a substantially round handle may be used as the instrument 40 of the present invention. A typical instrument 40 such as the pencil has a sharp end 42 and a handle portion 44 with a substantially round handle. Specifically, the handle portion 44 of the instrument 40 is inserted into the central opening/aperture 18*e* of the second opening 18 and pushed in the direction of arrow D as shown in FIG. 4A. As such, the instrument 40 is pushed inside the cavity 20 towards the first end 15 of the handle device 10 to tighten the instrument 40. Specifically, the instrument 40 slides inside the slot 22 when the instrument 40 is pushed inside the cavity 20. The instrument 40 gets tighter the more it is pushed inside the cavity 20. in order to firmly secured inside the body of the handle device 10. Accordingly, the handle portion 44 of the instrument 40 is firmly secured within the handle device 10. In one embodiment, the instrument 40 may be removed from the handle device 10 by applying lot of force in pulling the instrument 40 out of the handle device 10 via the opening 18. As shown in FIG. 4B, the handle portion 44 of instrument 40 is securely placed inside the slot 22 in the cavity 20 of the handle device 10.

Figure 5A:
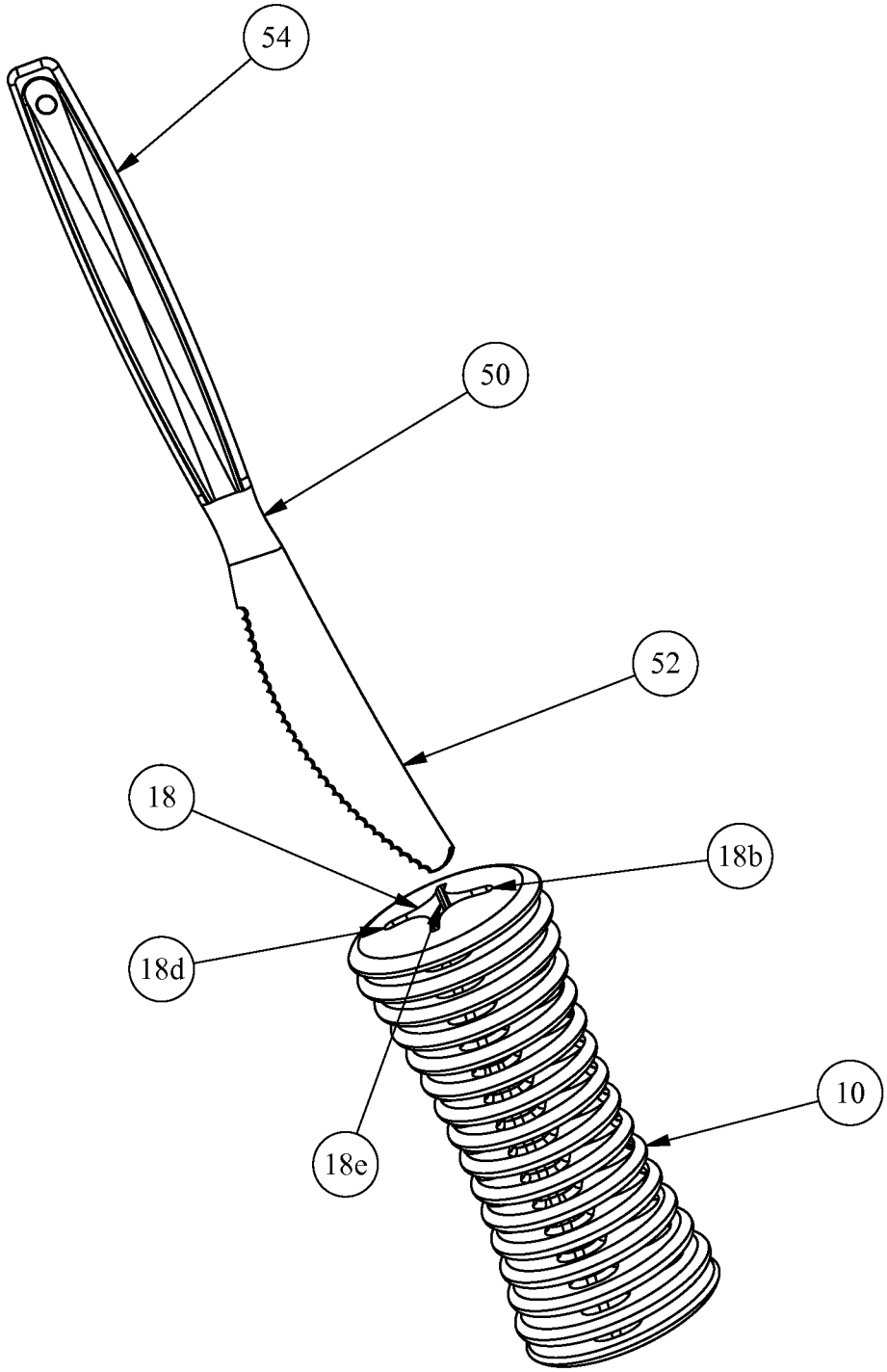
FIG. 5A is a top perspective view of a utensil being inserted into the handle device of FIG. 1 in accordance with a further embodiment of the present application.

In a further embodiment, FIG. 5A illustrates the handle device 10 with a utensil 50 inserted into the handle device 10. Although, the utensil 50 is shown to be a knife, one of ordinary skill would appreciate that other utensils such as chopsticks, skewers or other utensils, tools or instruments that have a substantially flat body may be used as the utensil 50 of the present invention. A typical utensil 50 such as the knife has substantially flat body including a substantially flat sharp portion 52 and a substantially flat handle portion 54. In order to attach the utensil 50 to the handle device 10, utensil 50 is aligned with the handle device 10 and the flat sharp portion 52 is inserted into the second opening 18 of the handle device 10 in the direction of arrow E as shown in FIG. 5A. As discussed above, the sides 18*b* and 18*d* of the second opening 18 are parallel to the substantially elongated first opening 16. As such, the flat sharp portion 52 is inserted into the second opening 18 via the central aperture 18*e* and the two sides 18*b* and 18*d*. It should be understood that the utensil 50 is inserted into the second opening 18 such that the flat handle portion 54 is placed at the inner surface 14 of the handle device 10 as further described in detail below.

Figure 5B:
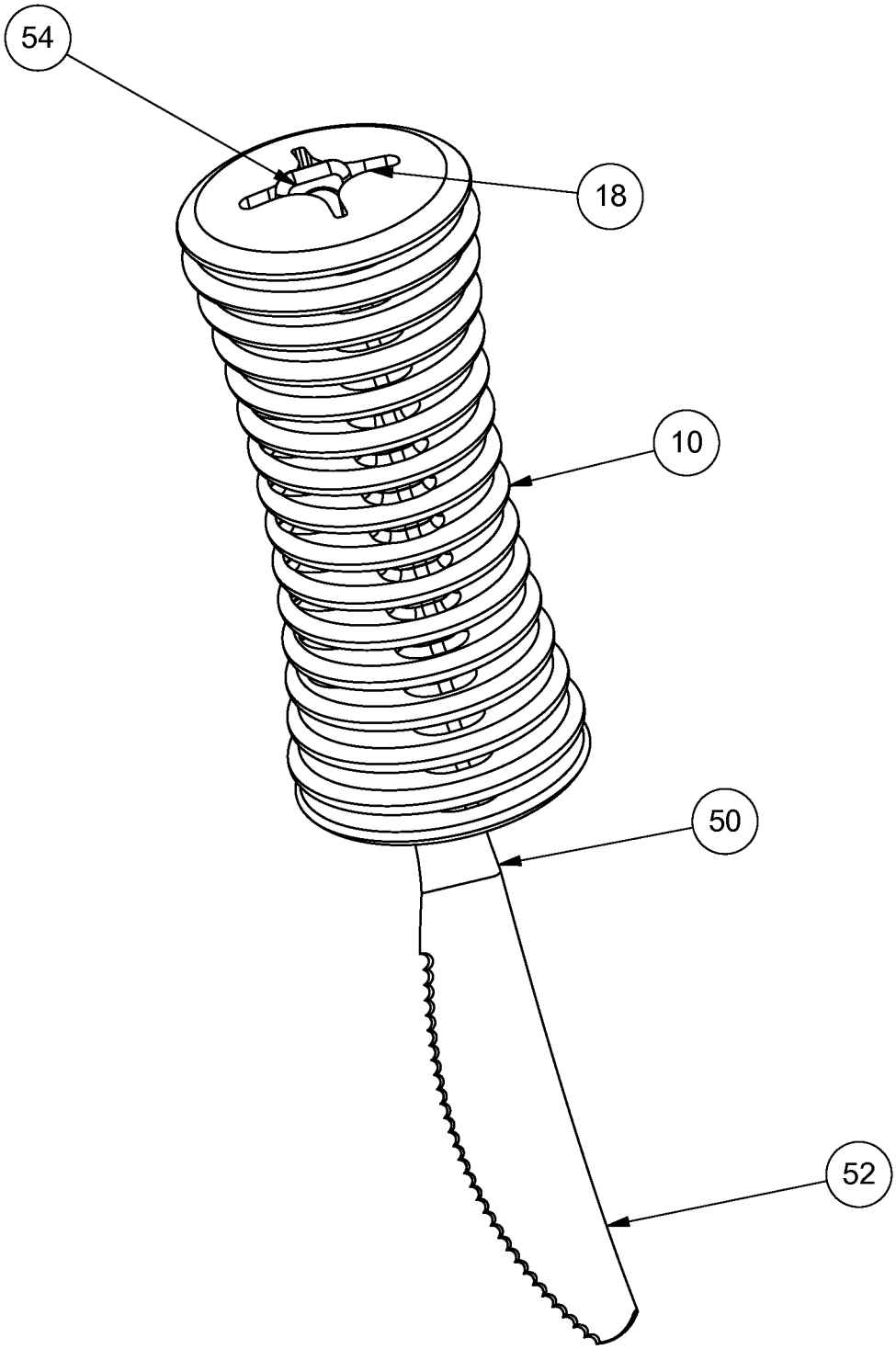
FIG. 5B is a bottom perspective view of the utensil inserted into the handle device of FIG. 1 in accordance with the further embodiment of the present application.
Figure 5C:
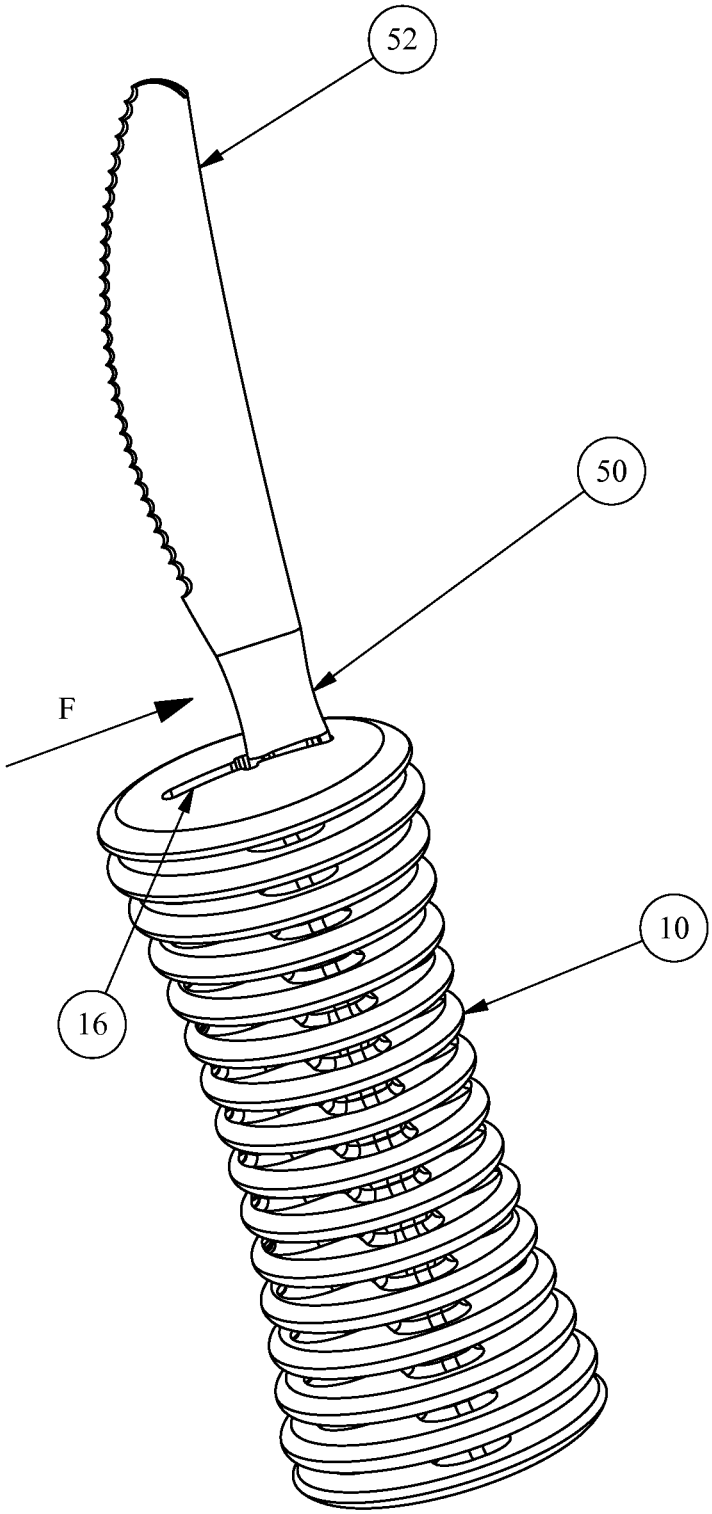
FIG. 5C is a top perspective view of the utensil being slidable in the handle device of FIG. 1 in accordance with the further embodiment of the present application.

As shown in FIG. 5B, the utensil 50 is inserted and pushed into the handle device 10 such that flat sharp portion 52 of the utensil 50 protrudes from the first opening 16 and the flat handle portion 54 lies within the cavity 20 of the inner surface 14 of the handle device 10. As shown, a lower part of the flat handle portion 52 is positioned adjacent to the second opening 18. As such, the lower part of the flat handle portion 52 is visible from the opening 18 of the second end 17 of the handle device 10. In one embodiment, a force may be applied to the utensil 50 in the direction F as shown in FIG. 5C in order to set the utensil 50 in place of the first opening 16 of the handle device 10. As such, the utensil 50 is securely and firmly placed within the cavity 20 of the inner surface 14 of the handle device 10. Similarly, the force may be applied in a direction opposite to the direction F in order to securely and firmly place the utensil within the cavity 20 of the inner surface 14 of the handle device 10.

It will be appreciated by those skilled in the art that changes could be made to the embodiments described above without departing from the broad inventive concept thereof. It will be understood, therefore, that this invention is not limited to the particular embodiments disclosed, but is intended to cover modifications within the spirit and scope of the present invention as defined by the appended claims.

What is claimed is:

1. A handle device comprising:

a substantially cylindrical hollow body having an outer surface, and inner surface forming a cavity, a first end, and a second end opposite the first end, a first opening is formed at the first end and a second opening is formed at the second end, the cavity extends from the first end to the second end and connects the first opening with the second opening;

wherein the first opening is a substantially t-shaped opening comprising an elongate first slot and two substantially perpendicular first slots located at a center portion of the elongate first slot on opposite sides of the elongate first slot, the two substantially perpendicular first slots are shorter than the elongate first slot;

wherein the second opening is a substantially star-shaped opening comprising a central aperture and four second slots extending from the central aperture, the four second slots are arranged substantially equally spaced apart from one another;

wherein the two substantially perpendicular first slots are aligned with two of the second slots; and the cavity expands when extending from the two substantially perpendicular first slots to the two aligned second slots.

2. The handle device of claim 1, wherein one of the first opening and the second opening is configured to receive a handle portion of an object.

3. The handle device of claim 2, wherein the two substantially perpendicular first slots are configured to prevent the object from being removed.

4. The handle device of claim 2, wherein the cavity further comprises a cavity slot for a secure placement of the object within the cavity.

5. The handle device of claim 1, wherein the cavity is configured for insertion of a handle portion of a substantially flat object.

6. The handle device of claim 1, wherein the body is made of an elastomeric material, a polymeric material, or a combination of both elastomeric material and polymeric material.

7. The handle device of claim 1, wherein the first opening is adapted to receive an object having a substantially flat shape.

8. The handle device of claim 1, wherein the second opening is adapted to receive an object having a substantially round shape.

9. A method of using the handle device of claim 1, the method comprising:

inserting a substantially flat handle of an object into the first opening of the hollow body of the handle device such that the substantially flat handle is substantially aligned with the elongate first slot; and rotating the object such that an upper part of the substantially flat handle of the object fits securely into the two substantially perpendicular first slots.

10. The method of using the handle device of claim 9, further comprising pulling an upper portion of the object such that the substantially flat handle slides in the cavity towards the first end.

11. A method of using the handle device of claim 1, the method comprising:

inserting a handle of an object into the second opening of the hollow body of the handle device; and pushing the handle of the object such that the handle slides into the cavity.

12. The method of using the handle device of claim 11, further comprising wherein the handle of the object is one of a substantially flat handle or a substantially round handle.

* * * * *